US005961150A

United States Patent [19]

Kogutt et al.

[11] Patent Number: 5,961,150

[45] **Date of Patent: *Oct. 5, 1999**

[54] INLAID PORTFOLIO OR FOLDER AND METHOD OF MAKING SAME

[75] Inventors: Randy A. Kogutt, Dallas; Michael A. Kogutt, Irving, both of Tex.

[73] Assignee: Dart Manufacturing Company, Dallas, Tex.

[ * ] Notice: This patent is subject to a terminal disclaimer.

[21] Appl. No.: 09/124,353

[22] Filed: Jul. 29, 1998

Related U.S. Application Data

[63] Continuation of application No. PCT/US98/00274, Jan. 13, 1998.

[51] Int. Cl.[6] ..... B42D 3/00

[52] U.S. Cl. ..... 281/37; 281/29

[58] Field of Search ..... 281/29, 37, 36, 281/31; 402/70, 73, 4

[56] References Cited

U.S. PATENT DOCUMENTS

| | | | |
|---|---|---|---|
| D. 223,644 | 5/1972 | Croon | D87/1 |
| D. 240,726 | 7/1976 | Harris | D19/33 |
| D. 241,381 | 9/1976 | Garnier | D87/3 A |
| D. 282,856 | 3/1986 | Daly | D19/33 |
| D. 319,729 | 9/1991 | Kogutt | D3/56 |
| D. 333,485 | 2/1993 | Kogutt | D19/32 |
| 2,639,168 | 5/1953 | Coppock | 283/64 |
| 4,847,798 | 7/1989 | Kurashima | 364/708 |
| 4,991,767 | 2/1991 | Wyant | 229/1.5 R |
| 5,020,828 | 6/1991 | Moor | 281/29 |
| 5,030,027 | 7/1991 | Bachrach et al. | 402/4 |
| 5,653,471 | 8/1997 | Koehn | 281/16 |
| 5,662,447 | 9/1997 | Tsai | 412/1 |
| 5,683,112 | 11/1997 | McQuenny | 281/29 |
| 5,704,646 | 1/1998 | Tzeng | 281/29 |
| 5,762,375 | 6/1998 | Kogutt et al. | 281/37 |

OTHER PUBLICATIONS

United States Postal Service Office Products ©1989.
Ateliers America, Inc. Brochure, Brushstroke Fine Art Executive Portfolios, pp. 2, 9, 10, 11, 12 date unknown.
Duratec Corporation, 1998, Leather and Simulated Leather Accessories Catalog, pp. 6, 7, 70.
Tasko Lederwarenfabrik GmbH, brichure, Jan. 1998.
Tapestry Portfolio, Hazel Mfg. Co., date unknown.
Hazel Mfg. Co. catalog, pp. 41–44, re Tapestry Portfolios, 1989.

*Primary Examiner*—Willmon Fridie, Jr.
*Attorney, Agent, or Firm*—Akin, Gump, Strauss, Hauer & Feld, L.L.P.

[57] ABSTRACT

A portfolio, folder or wallet is formed from a flexible leather or synthetic leatherlike cover member forming front and back covers with one of the covers having a window formed therein and a fabric inlay secured to the cover member around the periphery of the window. The inlay includes a multicolor image formed thereon by transferring the image from an image source, preferably by a transfer sheet using a multicolor photocopier, and thermally transferring the image on the transfer sheet to the inlay. The cover member may be preformed to include flap parts which are folded over to form pockets for various types of folders and wallets. Portfolios or desk folders are formed by including an interior liner and, preferably, stiffening elements in the form of flat rectangular sheets which may include a layer of resilient foam formed thereon and engageable with the backside of the inlay. The cover member and liner may be sewn or bonded together around the periphery of the portfolio or folder to secure the stiffening members spaced apart from each other with a spine or living hinge formed therebetween. Portfolios or folders with a wide variety of ornamental images in the folder window may be fabricated.

45 Claims, 5 Drawing Sheets

INLAID PORTFOLIO OR FOLDER AND METHOD OF MAKING SAME

This application is a continuation of International Application No. PCT/US98/00274, filed Jan. 13, 1998.

FIELD OF THE INVENTION

The present invention pertains to a portfolio, desk folder, wallet or similar article having an ornamental inlay on the cover and a method of manufacturing same.

BACKGROUND

Portfolios, desk folders, wallets and similar articles for storing and carrying business papers, note pads data storage discs and other items are widely used by persons in conducting day-to-day business as well as personal affairs. Portfolios and folders with ornamental features such as a popular trademark, symbol or other graphic image associated with a business entity, for example, are popular promotional, personal point of recognition and gift items.

Portfolios, desk folders and similar articles of the general type described herein are typically fabricated of a soft, durable material such as fabrics, leather or a synthetic leatherlike material. The application of ornamental designs or pictorial scenes on the cover or other portions of such articles is somewhat constrained by the inability to provide a suitable ornamental or pictorial feature on the surface of leather or synthetic leatherlike materials. Still further, in the production of promotional and gift articles it is desirable to be able to make relatively small quantities of such articles with a particular ornamental or pictorial applique on the article and to quickly change the pictorial or ornamental feature to a different design without interrupting production or without requiring significant modifications to the production process.

The above-mentioned desiderata and the problems associated with the prior art have been met with the present invention wherein a unique portfolio, desk folder, wallet or similar article includes an ornamental inlay and which is fabricated in such a way that an inexpensive yet aesthetically appealing article is provided and which article may be adapted to include one of a wide variety of ornamental features or graphic or pictorial scenes thereon.

SUMMARY OF THE INVENTION

The present invention provides an improved portfolio, desk folder, wallet or similar article including an inlay which may be provided on the exterior or interior of a cover or liner for the article and which may be provided with one of a wide variety of ornamental or pictorial images on the inlay. The present invention also provides a method of making a portfolio, desk folder or similar article having an inlay thereon and which inlay may be characterized by one of virtually an infinite variety of multi-color images applied thereto.

In accordance with one important aspect of the present invention a business portfolio, desk folder, wallet or similar article is characterized by front and back cover parts which are integrally joined at a spine portion. The cover parts comprise a flexible cover member which may be made of a single piece of flexible, soft and durable material and including a window, preferably formed in the front cover part. The portfolio may also include an inner liner for the front and back cover parts. The liner may be secured to the cover parts to enclose and support stiffeners for the front and back cover parts.

The invention further includes an inlay or so called window pane formed of a sheet of flexible material, including woven fabric or similar material on which an ornamental design or image is applied, preferably by a thermal transfer process, and the inlay is attached to the portfolio or folder so that it is viewable through the window. The window may be provided in one or the other or both of the cover parts or, if desired, in the liner.

The present invention also provides an improved and aesthetically pleasing portfolio, wallet folder or similar article wherein a multi-color image is transferred to an inlay part or window pane which is then suitably secured in a window formed in a cover part of the article and the article is then assembled in such a way as to retain the window pane in a desired position in an improved manner.

In a preferred method of manufacture of an article in accordance with the invention, a flexible sheet-like cover member is formed by die cutting the cover member out of a sheet of flexible material and a window is preferably simultaneously, cut in the cover member. A window pane is formed of a flexible material, such as woven polyester, an image to be applied to the window pane is chosen and this image is transferred to the window pane. One preferred transfer process comprises transferring an image from a source by way of a multi-color photocopier to a sheet of transfer paper. The transfer paper is then applied to the inlay or window pane and the image is thermally transferred to the window pane. The window pane may then be conveniently attached to the cover member at the window by, for example, sewing the window pane to the cover at the window, preferably around the periphery thereof.

The inlay is preferably covered by an inner liner portion of the article. Certain articles, such as portfolios and desk folders may include separate front and back cover stiffeners and a liner which are assembled to the cover by securing the liner to the cover at the periphery thereof with the stiffeners trapped therebetween. The front and back covers may be attached around their perimeter to the liner and, preferably, the stiffener so as to form a strong, durable and aesthetically pleasing article.

The liner may be provided with its own stiffener layer such that, in effect, each of the front and back cover portions of the article have two layers of stiffener members. Still further, the stiffeners may comprise a chipboard type material with a layer of polymer foam adhered thereto and disposed between the stiffener and the inlay and cover members. The inlay member itself may be backed by a layer of polymer foam material. In this way, it has been discovered, the windowpane or inlay is held more taut and flat and does not tend to loosen or wrinkle with use.

Those skilled in the art will further appreciate the above-mentioned advantages and features of the invention together with other important aspects thereof upon reading the detailed description which follows in conjunction with the drawing.

DESCRIPTION OF THE PREFERRED EMBODIMENTS

Figure 1:
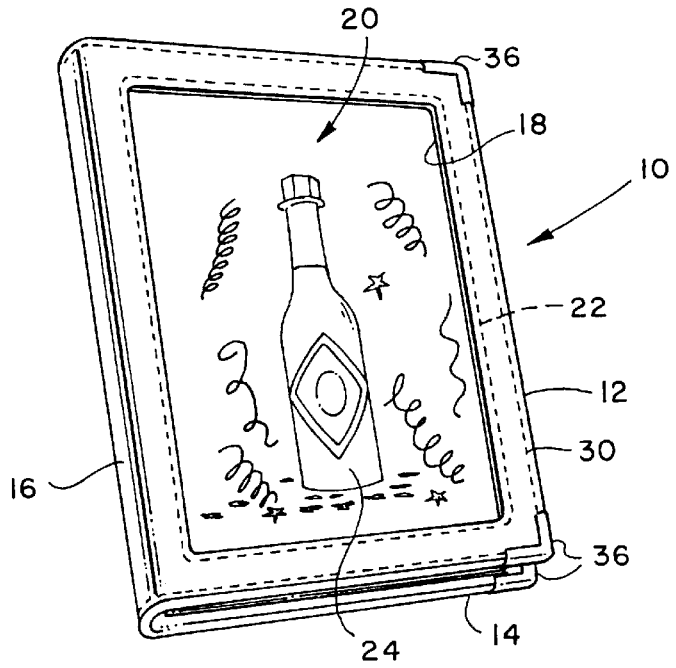
FIG. 1 is a perspective view of a portfolio in accordance with the present invention in the closed position of the front and back covers and showing an ornamental inlay on the front cover.

In the description which follows like elements are marked throughout the specification and drawing with the same reference numerals, respectively. The drawing figures are not necessarily to scale and certain features may be shown in generalized or somewhat schematic form in the interest of clarity and conciseness.

Figure 2:
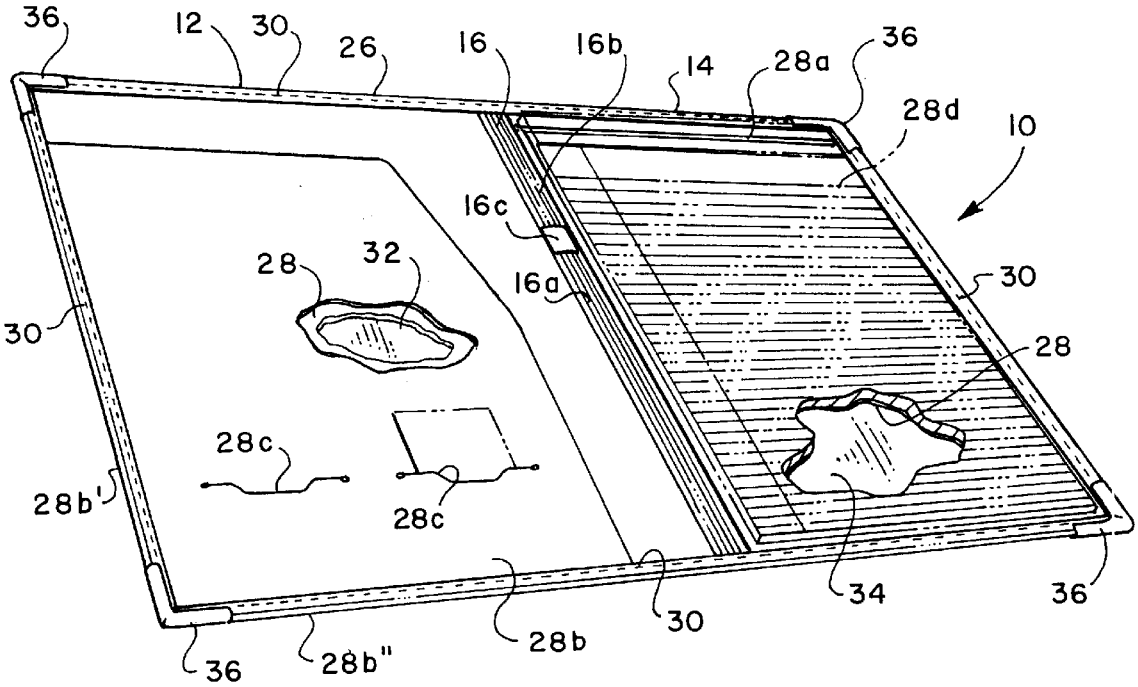
FIG. 2 is a perspective view of the portfolio shown in FIG. 1 in an open position.

Referring to FIGS. 1 and 2, there is illustrated one preferred embodiment of an article in accordance with the invention comprising a portfolio or desk folder, generally designated by the numeral 10. The portfolio 10 is characterized by front and back cover parts 12 and 14 which are hinged together at a spine portion 16, not unlike the front and back covers of a hard-bound book. The front and back covers may be moved between a folded or closed position, as shown in FIG. 1, and an open position as shown in FIG. 2. As shown in FIG. 1, the front cover part 12 is provided with a generally rectangular window 18 formed by removing the material forming the cover part 12 in a selected geometric pattern, such as a rectangle, as shown. The window 18 may be of other shapes and more than one window may be provided. The window 18 is adapted to show an inlay, generally designated by the numeral 20, which is suitably secured to the portfolio 10, including the cover part 12, in a manner to be described in further detail herein. The inlay 20 is preferably formed of a sheet of flexible material including fabric which may be secured to the front cover part 12 by conventional stitching 22 around the periphery of the window 18, as indicated in FIG. 1. Other means for securing the inlay or window pane 20 to the cover part 12 may also be provided, including thermal or chemical bonding or other forms of adhesion. Typically, the inlay 20 is formed of a piece of durable fabric to which has been applied ornamental indicia or a pictorial image 24, which image may comprise a wide variety of subject matter, including anything from an image of a product of commerce to a pastoral scene. Manufacturers of industrial or consumer products, or services, for example, may advantageously provide portfolios, such as the portfolio 10, with an image of their product or the company trademark or logo imprinted on the window pane or inlay 20 in accordance with the invention. Virtually any two-dimensional image may be applied to the inlay 20 in accordance with the invention and the inlay then applied to or secured to the portfolio 10, also in accordance with the invention.

The portfolio 10 is preferably characterized by a generally rectangular cover member 26, FIG. 2, forming the cover parts 12 and 14 and the spine 16 and an inner liner 28 formed of a single piece of flexible material having approximately the same rectangular shape as the cover member 26 and suitably secured thereto all around the periphery of the portfolio 10, such as at stitching 30. The stitching 30 may be ornamental as well as functional and is operable to aid in reinforcing the portfolio and determining the location of two, generally rectangular stiffener members 32 and 34, portions of which are shown through broken away portions of the liner 28 in FIG. 2. The stiffener members 32 and 34 are generally rectangular plate-like members, preferably formed of durable fiberboard, expanded plastic foam sheet, cardboard or so-called chipboard, which are placed between the cover member 26 and the liner 28 and are also secured in place preferably by chemical, thermal, radio frequency, ultrasonic or other forms of welding of the liner to the cover member around the periphery thereof, followed by further securing the cover member to the liner with the stitching 30. In a preferred embodiment of the stiffener members 32 and 34, the stiffener members comprise forty point to one hundred point commercial chipboard including a layer of resilient polymer foam material adhered to one surface of the stiffener, such surface facing the inside surface of the cover parts and in supportive engagement with the inlay 20.

The spine 16, for example, may be suitably reinforced by bonding the liner 28 to the cover member 26 along the striations 16*a* and 16*b*, for example. An integral loop of liner material 16*c* may be formed to serve as a pen or pencil holder. The liner 28 may have a suitable slot 28*a*, or other means thereon for retaining suitable articles inside the portfolio such as a tablet 28*d*, for example. A flap formed of a third layer of material 28*b* may be provided and bonded to the liner 28 along and adjacent to the side and bottom edges 28*b*' and 28*b*" to form a pocket between the liner and the flap. Suitable slots 28*c* are formed in the flap 28*b* for retaining business cards, etc., therein. The portfolio 10 may also be provided with ornamental and protective metal corner members 36 suitably attached by crimping, for example, to the top and bottom corners of the front cover part 12 and the back cover part 14, as shown in FIGS. 1 and 2.

The dimensions of a portfolio 10 in accordance with the present invention may, typically, be in the range of about 9.5 by 12.5 inches, for example, in the folded position shown in FIG. 1, thereby making the overall length of the portfolio, in the open position, to be in the range of about 19 inches. The window 18 is typically, although not necessarily, rectangular in shape and may be about 7.6 inches wide by 10.2 inches in length or height. The slot 28*a* and flap 28*b* are exemplary and other slots or means may be provided for retaining items, such as notebooks, checkbooks, tablets, calculators, business cards and other articles secured within the portfolio 10. The window 18 may be of a different size and geometry from that shown and other window panes may be provided in the back cover part 14 or the interior of the portfolio 10, such as in the liner 28 or flap 28*b*. However, the location of the window 18 on the exterior of the front cover part 12 is preferred.

A typical material used for fabricating the cover part 26 is, for example, leather or a fabric-backed or otherwise reinforced vinyl sheet of about 0.050 inches in thickness. The liner 28 and flap 28*b* may be formed of 0.015 inches thick vinyl film or the like. The window pane 20 is preferably formed of a heat resistant fabric, such as a 600 denier, woven, heat resistant polyester and the like. Other materials may be used for the window pane or inlay 20, the liner 28, flap 28*b* and the cover member 26 as will be appreciated by those skilled in the art. The cover member 26, the liner 28 and flap 28*b* are preferably secured to each other by adhesives and/or bonding techniques as will be described further herein and the portfolio 10 is assembled by stitching at 22 and 30 using conventional equipment for stitching articles of manufacture made from soft flexible materials, such as leather or so called synthetic vinyl leather. The width of the peripheral edge or border of the cover member 26, whereby the cover member is larger than the liner 28 to permit folding the edge over and securing same to the liner 28 and to the cover member itself by the stitching 30, may be appropriate for the particular size of portfolio fabricated. A width of a peripheral border or hem 31, FIG. 2, of about 0.40 inches is indicated to be suitable for the dimensions given hereinabove.

Figure 3:
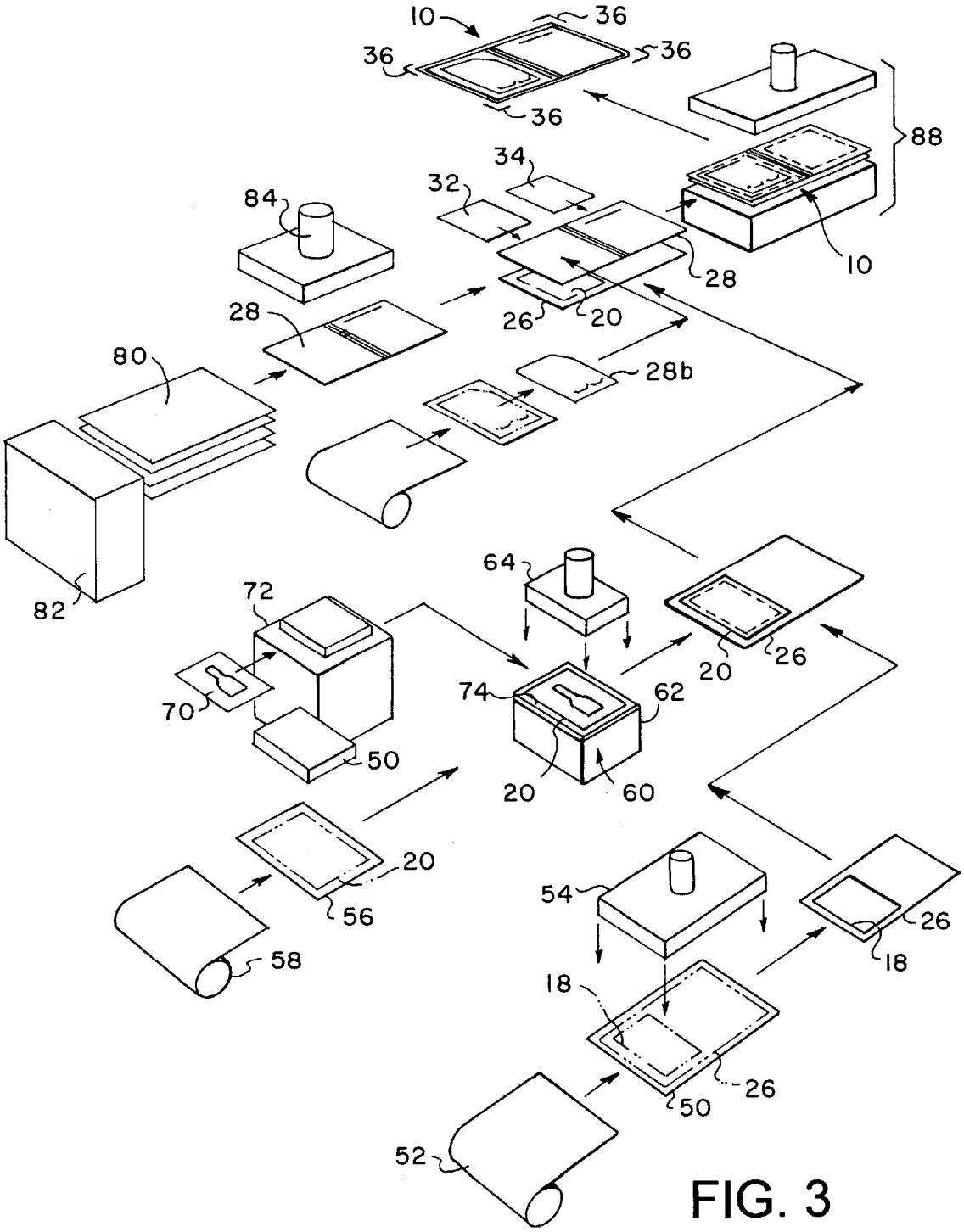
FIG. 3 is a schematic diagram illustrating certain steps in the manufacture of the portfolio shown in FIGS. 1 and 2.

Referring now to FIG. 3, a preferred method in accordance with the invention for manufacturing a portfolio 10 with an inlay 20 is at least partially illustrated in somewhat schematic form and will be described as follows. Cover members 26 may be fabricated by cutting suitable sheets 50 from a roll of material 52. The cover member 26 and the window 18 may be formed simultaneously by die cutting a sheet 50 using suitable die cutting apparatus 54 to provide a cover member 26, as illustrated. The window pane or inlay 20 may also be fabricated by providing suitable sheets 56 of window pane material from a roll 58 thereof and die cutting the window pane to a predetermined size using suitable die cutting apparatus 58. After forming the window pane 20 it is preferably placed on a thermal transfer apparatus 60 including a transfer apparatus bed 62 and a movable platen or cover 64. The transfer apparatus 60, 62, 64 may be of a type manufactured by INSTA as their model 826. Image transfers may be provided for application to the window pane 20 by selecting a suitable two-dimensional image such as photoprint 70 or a similar article, placing this article on a suitable multi-color photocopier 72, FIG. 3, such as a so called color laser copier of a type manufactured by Canon as their model 500 Color Laser Copier. The image from the article 70 is thus transferred to a transfer sheet 74 in the photocopier 72, which sheet is then placed on and contiguous with the window pane or inlay 20 prior to operating the transfer apparatus 60 to thermally transfer inks on the transfer sheet to the window pane or inlay 20. The transfer sheets 74 may be of a type commercially available, such as a type made by Airwaves as their One-Step Elite color laser transfer paper. The image produced on a transfer sheet may be required to be inverted or a mirror image if alpha numeric text is to be readable on the final inlay image, for example. A finished window pane or inlay 20 is shown in FIG. 3 inverted and laying on a cover member 26 and covering the window 18.

The use of a multicolor photocopier and the type of transfer sheet described above is advantageous. However, other image transfer techniques may be utilized to transfer inks of different colors to the inlay 20, such as silk screen application techniques, computer controlled ink jet application techniques or offset printing, for example.

The process of providing a suitable image on a transfer sheet 74 includes the further steps of trimming the image field or peripheral nonimage areas from the transfer paper prior to application to the image portion of the sheet surface of the window pane or inlay 20 on the transfer apparatus 60. Still further, determining the specific position of the transfer sheet 74 on the inlay or window pane 20 must be properly carried out.

Once the inlay 20 has been provided with a multi-color image thereon and positioned in the window 18 of the cover member 26 the inlay may be adhered to the cover member with a suitable adhesive disposed at the corners of the inlay, for example, or in any position thereon suitable to adequately retain the inlay in the window 18. This step in the preparation of the cover member 26 is followed by sewing the inlay or window pane 20 to the cover member with stitching 22.

Concomitant with preparation of the cover member 26 as described above, the liner 28 may be prepared by generating suitable numbers of sheets 80 of liner material with a conventional sheeting apparatus 82 such as a type manufactured by Colbus Sheeter as their model 981290. Single sheets 80 may then be die cut to provide the liner 28 using a suitable die cutting apparatus 84. The flap 28*b* may be cut from a roll or from sheets produced by the apparatus 82 also, and then die cut to the desired shape. Alternatively, all die cut parts of the portfolio 10 may be precut in desired quantities using the same die cutting apparatus, and using the appropriate die for each part, and the parts then stored for use when portfolios are to be assembled.

After forming the liner 28 and flap 28*b* and preparing the cover member 26 as described above, the cover member is placed on a suitable surface such that the stiffener members 32 and 34 may be properly positioned on the cover member.

As shown in FIG. 3 the stiffener members 32 and 34 may each have a layer of polymer foam material 32*a* and 34*a*, respectively, applied to the surface which faces the cover member 26 and the backside or inner surface of the inlay 20. In this way, when the portfolio 10 is assembled, the exterior of the portfolio has a soft, somewhat cushioney feel, which is desirable. Moreover, the provision of the polymer foam backing or layer on the stiffener member 32, in particular, aids in maintaining the inlay 20 taut and smooth and eliminates the chance of wrinkles or looseness in the inlay which is, at least, not aesthetically pleasing. The liner 28 is then placed over the cover member and the stiffeners 32 and 34, followed by placing the flap 28*b* over the liner and then sealing the flap and liner to the cover member using a conventional apparatus 88 which thermally or mechanically welds the liner to the cover member around the periphery of each. One example of such apparatus is a model F15-30 manufactured by Thermatron. Stitching 30 is then applied around the periphery of the portfolio 10 to sew the cover member 26 to itself, to the liner 28 and flap 28*b* and to the stiffener members 32 and 34. Lastly, the reinforcement or corner members 36 may be suitably crimped to the respective corners of the portfolio 10 in the positions shown in FIGS. 1 and 2.

Those skilled in the art will recognize that a unique method of fabricating an ornamental or inlaid portfolio or desk folder may be carried out in accordance with the invention using conventional manufacturing equipment, image transfer equipment and materials while providing a functional and aesthetically pleasing article of manufacture which may have two-dimensional images of a virtually infinite variety applied thereon. The selection of a material for the window pane or inlay 20 may vary. A woven polyester of the type described above is advantageous and provides an aesthetically pleasing texture to the inlay for a wide variety of images printed thereon. The above-mentioned types of transfer paper also apply a somewhat protective coating to the image transferred to the inlay or window pane.

Figure 4:
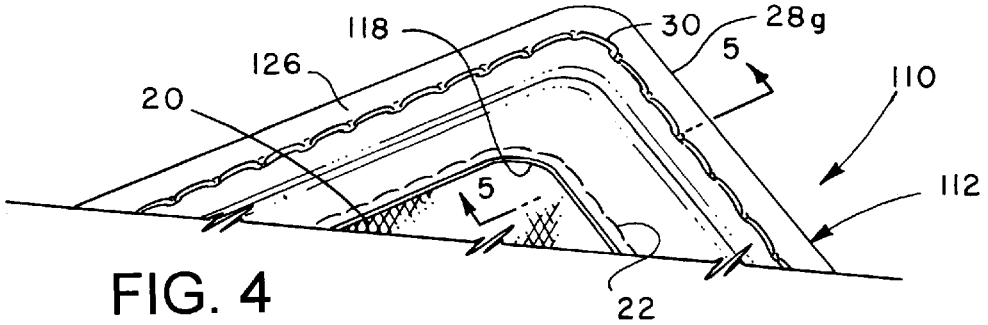
FIG. 4 is a detail perspective view of a portion of a first alternate embodiment of an article in accordance with the present invention.
Figure 5:
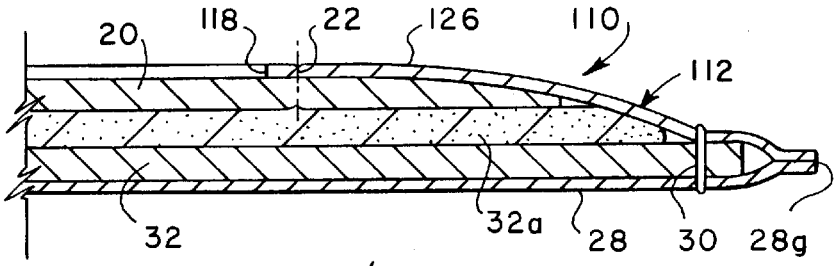
FIG. 5 is a section view taken along the line 5—5 of FIG. 4.

Referring now to FIGS. 4 and 5 a first alternate embodiment of an article in accordance with the invention is partially illustrated and comprises a portfolio or folder 110, a portion of which, comprising a portion of the front cover 112, is illustrated. The portfolio 110 is fabricated in a manner similar to the portfolio 10.

However, as shown in FIG. 5 the portfolio 10 includes a cover member 126, a window 118 formed therein and an inlay 20 disposed in the window and secured thereto by stitching 22. Still further, as previously mentioned, the stiffener 32 may be provided with a layer of relatively soft or low durometer polymer foam 32*a* secured thereto or otherwise disposed in supportive relationship to the inlay 20 as well as the cover member 126. Such an arrangement provides the advantages previously mentioned of providing a soft cushiony feel to the portfolio or folder 110 and to provide for holding the window pane or inlay 20 in a relatively taut or stretched condition.

As shown in FIG. 5, another modification found in the portfolio 110 is that whereby an interior liner 28 is secured to the cover member 126 at a peripheral edge, a portion of which is shown and indicated by numeral 28*g*, and whereby the liner and the cover member 126 are thermally bonded to each other at such peripheral edge. In addition to thermal bonding the cover member 126 to the liner 28 as described above, stitching 30 is provided all around the edge of the portfolio 110 in the same manner, essentially, as provided for the portfolio 10. Alternatively, the entire edge of the portfolio 110 may also be provided with a separate channel shaped hem member, not shown, secured with the stitching 30.

Figure 6:
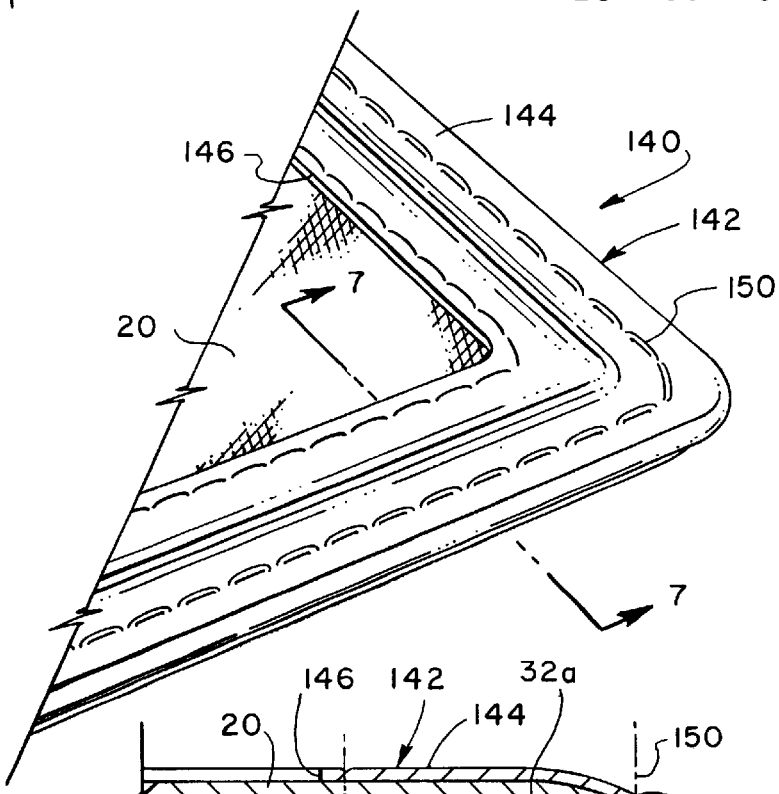
FIG. 6 is a detail perspective view of a portion of a second alternate embodiment of an article in accordance with the present invention.
Figure 7:
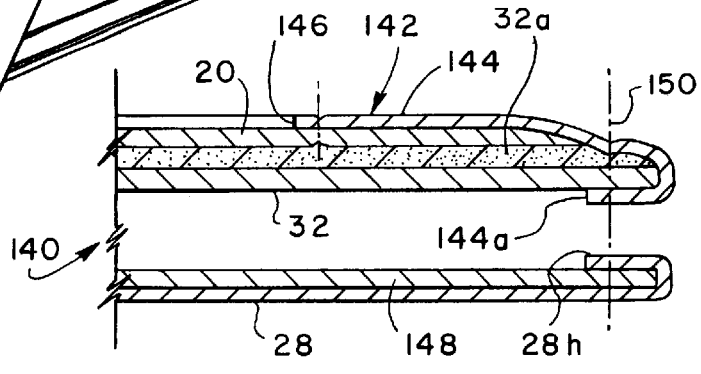
FIG. 7 is a section view taken along the line 7—7 of FIG. 6.

Referring now to FIGS. 6 and 7, another embodiment of a portfolio or folder type article in accordance with the invention is illustrated and generally designated by the numeral 140. The article 140 is only partially shown in the form of a part of the front cover 142 which is fabricated from a cover member 144 similar to the cover member 26 or 126 and having a window 146 formed therein to permit display of an inlay 20. The inlay 20 is secured to the cover member 144 around the edge of window 146 by stitching 22 in the same manner as for the portfolios 10 and 110. As shown in FIG. 7, the construction of the portfolio 140 is substantial in that the cover member 144 overlies the inlay 20 as well as a stiffener member 32 including the polymer foam layer 32*a* in supportive relationship to the cover member and the inlay. In the arrangement of the portfolio 140, the peripheral edge 144*a* of the cover member 144, FIG. 7, is folded over the edge of the stiffener 32 and suitably adhered thereto by an adhesive, for example.

As further shown in FIG. 7, an interior liner of the portfolio 140 includes a liner member 28 which is attached to a second stiffener member 148 having substantially the same dimensions as the stiffener member 32. The peripheral edge 28*h* of the liner 28 is folded over the peripheral edge of the stiffener 148 and suitably secured thereto. Alternatively, an additional inner liner member, not shown, may be provided overlying the stiffener 148 and secured to the liner member 28 at its peripheral edge by a thermal sealing or bonding process similar to that used for bonding the cover member 126 to the liner 28 of the portfolio article 110. After the cover member 142 and inner liner assembly are separately formed as described above they are secured to each other by stitching 150, as indicated in FIGS. 6 and 7.

The steps described above for assembling the embodiments of the portfolios illustrated in FIGS. 4–7 may be carried out in conjunction with the other steps of the process described hereinabove in conjunction with FIG. 3.

Figure 8:
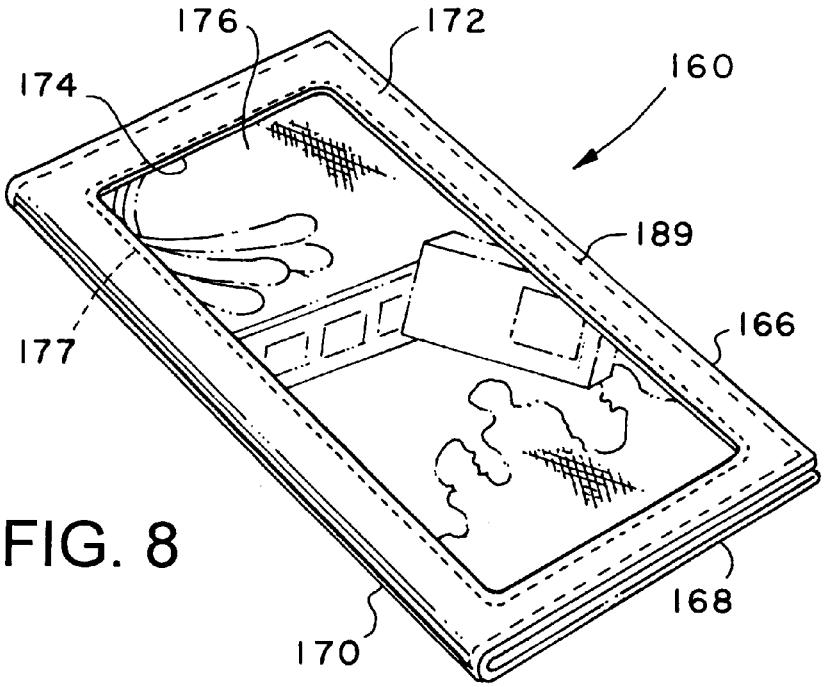
FIG. 8 is a perspective view of a third alternate embodiment of an article in accordance with the invention in the closed position of the front and back covers and showing an ornamental inlay on the front cover.
Figure 9:
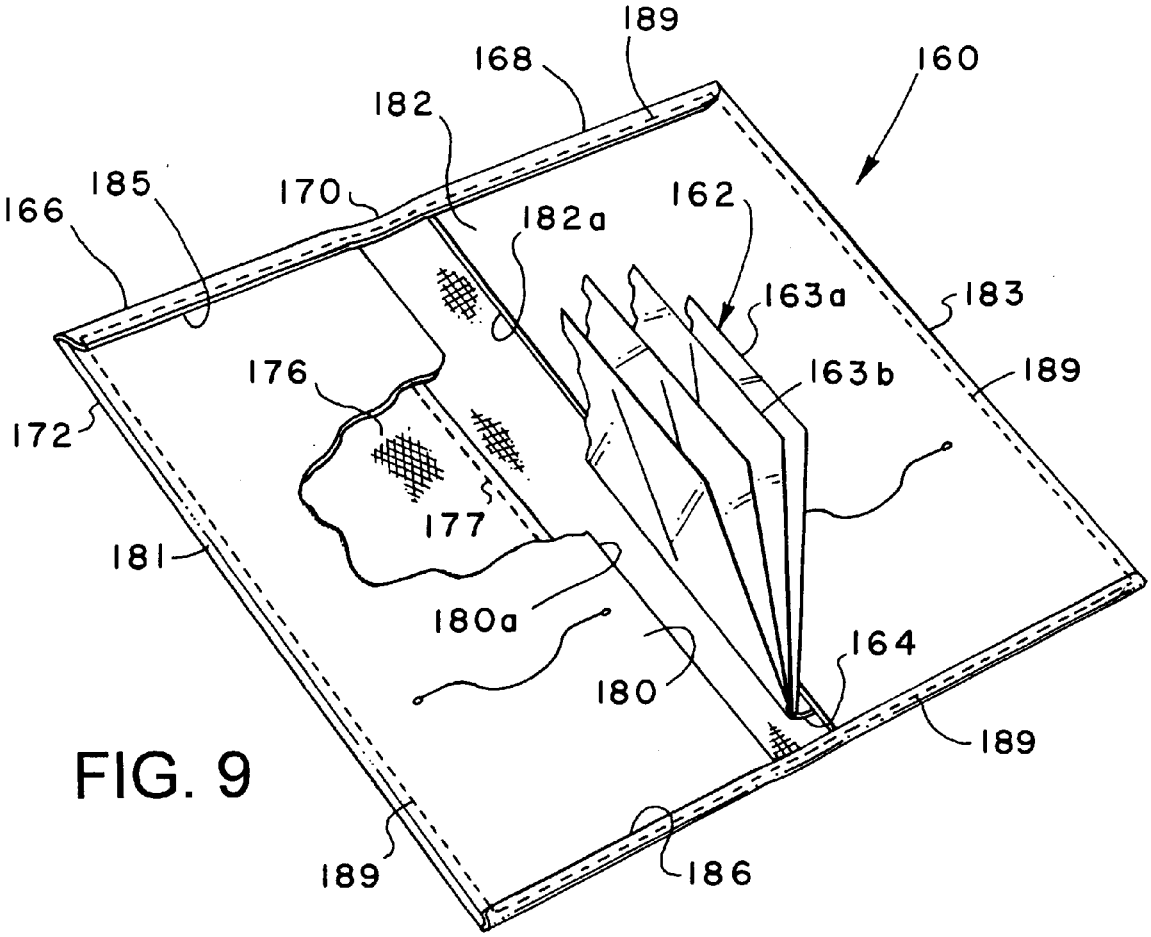
FIG. 9 is a perspective view of the article shown in FIG. 8 in an open position with portions of the article broken away for clarity.

Referring now to FIGS. 8 and 9, a third alternate embodiment of a folder or like article in accordance with the invention is illustrated and generally designated by the numeral 160. The article 160 is characterized as a folder for storing and covering generally planar articles such as business cards, data storage disks or a checkbook. As shown in FIG. 9 by way of example, an insert 162 comprising plural pocket forming members 163*a*, 163*b* and so on is attached to a tongue portion 164 for securement to the folder 160. The folder 160 is characterized by front and back cover parts 166 and 168 which are integrally joined at a spine or living hinge portion 170. The folder 160 may, in fact, be formed of a piece of fabric reinforced polymerlike material, such as vinyl, and comprising a single cover member 172 in which a window 174 is cut to provide for positioning therein an inlay 176 having a suitable multicolor image formed thereon. The inlay 176 may be formed of the same material as the inlay 20 and have an image formed thereon in the same manner as previously described.

As further shown in FIGS. 8 and 9, the inlay 176 is preferably secured to the member 172 at the window 174 by suitable stitching 177 around the periphery of the window. As shown in FIG. 9, a preferred characterization of the folder 160 is obtained by cutting the cover part 172 in proportions which provide left and right pocket forming flap parts 180 and 182. Parts 180 and 182 are formed by folding the cover member 172 at 181 and 183. Then, by providing the cover member 172 also with top and bottom hem portions 185 and 186, these portions are folded over the flap parts 180 and 182 as shown. The folder 160 is finally assembled by stitching 189 around the entire periphery of the folder, as shown in FIG. 9. to secure the hems 185 and 186 to the flap parts 180 and 182 along their top and bottom edges while leaving the flap parts unsecured to the cover member at edges 180*a* and 182*a* to form the aforementioned pockets. As shown in FIG. 9, tongue 164 is insertable in the pocket formed by the flap part 182 to secure the member 162 in the folder 160.

In the fabrication of the folder or article 160, the stiffener parts previously described for the embodiments of FIGS. 1, 2 and 4–7 have been eliminated. The inlay 176 is covered on the interior of the folder by the flap part 180 but the folder 160 enjoys a substantial number of the benefits and advantages of an article in accordance with the invention as well as the method of making same. As will be appreciated from the foregoing description, the fabrication of the folder 160 may, after securing the inlay 176 to the cover member 172 in the manner described above in conjunction with FIG. 3, comprise merely folding the flap parts 180 and 182 over into the positions generally as shown in FIG. 9, followed by folding the hems 185 and 186 into the positions shown and then stitching the hems and flap parts at stitching 189.

Figure 10:
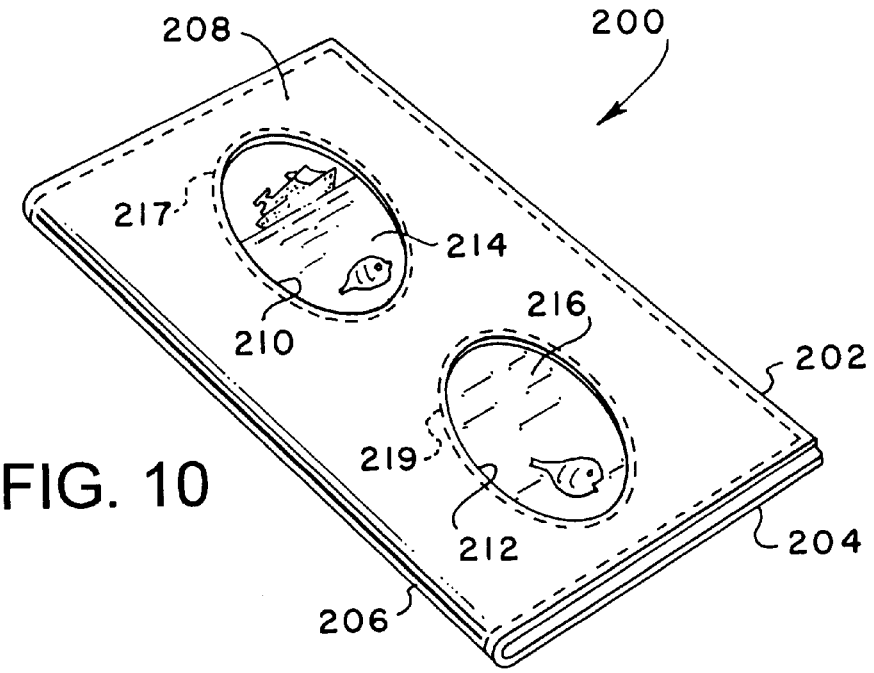
FIG. 10 is a perspective view of a fourth alternate embodiment of a folder in accordance with the invention in a closed position of the front and back covers.
Figure 11:
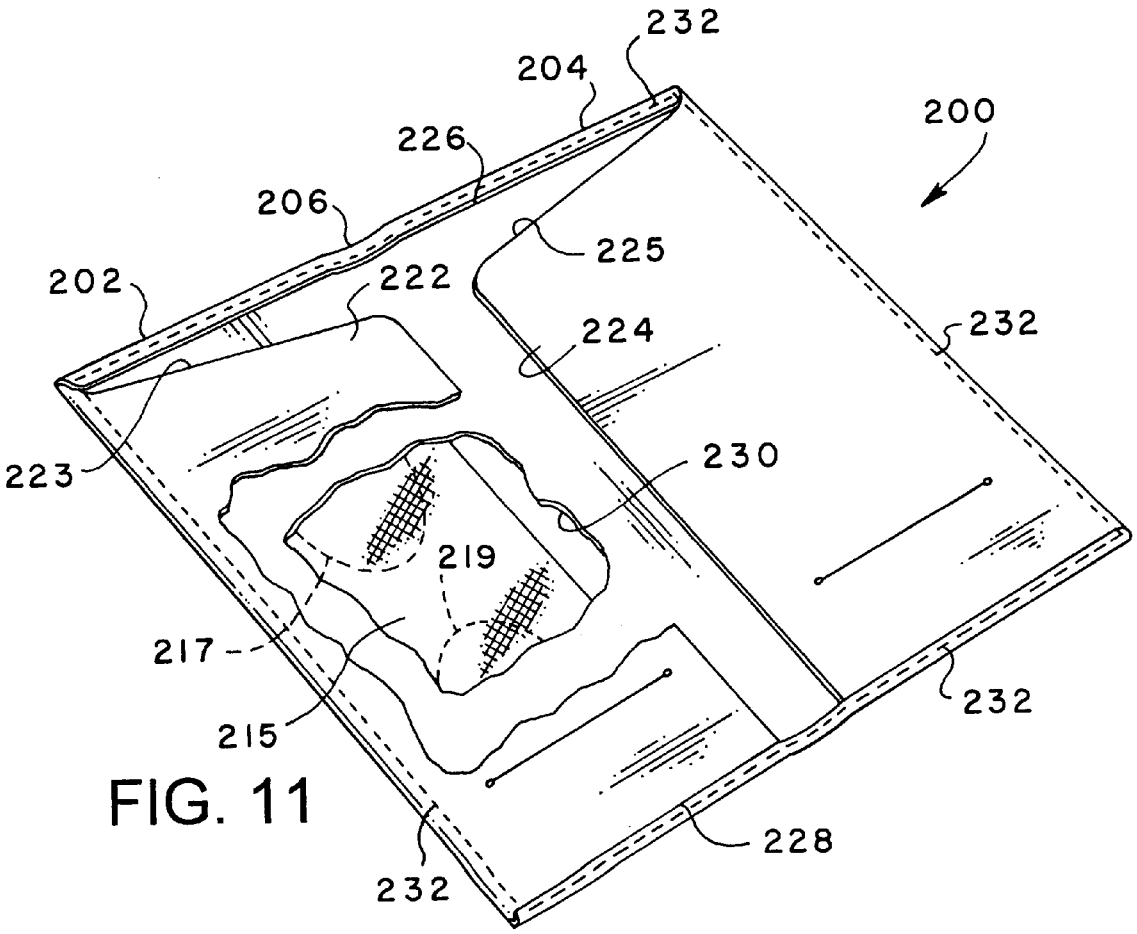
FIG. 11 is a perspective view of the folder shown in FIG. 10 in the open position.

Referring now to FIGS. 10 and 11, another embodiment of a folder, wallet or like article in accordance with the invention is illustrated and generally designated by the numeral 200. The folder 200 includes front and back cover parts 202 and 204 which are joined at a fold or living hinge portion 206 and are characterized by a cover member 208, preferably formed of the same material as the cover member 172. The front cover portion or part 202 of the cover member 208 is provided with two spaced apart oval shaped windows 210 and 212 in which window panes or inlays 214 and 216 are disposed. The inlays 214 and 216 may be formed on a single member 215 comprising a piece of inlay fabric of the type described above and secured to the cover member 208 at the windows 210 and 212 by stitching 217 and 219 about the periphery thereof, respectively.

As shown in FIG. 11, the folder 200 is also formed to have interior flap parts 222 and 224 which are formed integrally with the cover member 208 as are top and bottom hem portions 226 and 228. The folder 200 is also formed with a generally rectangular inner liner member 230, shown partially broken away in FIG. 11 to illustrate the position of the inlay member 215 which forms the inlays 214 and 216. The liner 230 may be formed of the same material as the liner member 28, for example. The flap parts 222 and 224 have relieved or scarfed surfaces 223 and 225 to provide access to pockets formed between these flap parts and the liner 230, respectively.

Fabrication of the folder 200 follows, generally, at least some of the steps set forth above for the fabrication of the portfolio or folder 10 as well as the folder 160. After forming the cover member 208 and providing images on the member 215 which forms the inlays 214 and 216 the member 215 is properly positioned in the windows 210 and 212 and stitched in place at stitching 217 and 219, for example. The liner 230, after being cut to proper size, is then placed in position covering the member 215 after which the flap parts 222 and 224 are folded over to the positions shown in FIG. 11 and, after folding the hems 226 and 228 into the positions shown in FIG. 11, the folder 200 is stitched at stitching 232 around the entire periphery thereof, as illustrated, to secure the flap parts, the liner and the hems in position. As with the folder 160, the folder 200 does not utilize any stiffener members but enjoys the advantages of an easily fabricated article which may have a wide variety of images placed thereon, viewable in the windows 210 and 212, and in accordance with the present invention.

Although preferred embodiments of a portfolio, folder or similar article and methods of making same have been described in detail hereinabove, those skilled in the art will recognize that various substitutions and modifications may be made to the invention without departing from the scope and spirit of the appended claims.

What is claimed is:

1. A method of making an article comprising a folder or portfolio comprising an exterior cover member including a window formed in said cover member and an inlay having a printed image thereon disposed in said window and secured to said portfolio to provide ornamental indicia on said portfolio, said method comprising the steps of:

forming said cover member;

forming a window in said cover member;

forming said inlay from a sheet of flexible material;

providing an image on said inlay;

placing said inlay at said window with said image substantially within said window and securing said inlay to said cover member.

2. The method set forth in claim 1 wherein:

said cover member is formed to have foldable flap parts forming pockets on the interior of said folder and said method includes the steps of:

folding said cover member to form said flap parts and securing said flap parts to another portion of said cover member to form said pockets.

3. The method set forth in claim 1 or 2 comprising the steps of:

forming a flexible interior liner adapted to be secured to said cover member and securing said cover member to said liner with said inlay disposed therebetween.

4. The method set forth in claim 3 including the steps of:

placing at least one stiffening part between said cover member and said liner.

5. The method set forth in claim 4 wherein:

the step of placing said stiffening part includes providing separate stiffening parts for a front cover portion and a back cover portion of said folder wherein at least one of said stiffening parts is positioned in supportive relationship to said inlay.

6. The method set forth in claim 4 or 5 wherein:

said stiffening part includes a layer of resilient foam material and said stiffening part is placed in supportive relationship to said inlay with said layer of foam material in contact with said inlay.

7. The method set forth in claim 4 including the step of:

securing said cover member to said liner by bonding said cover member to said liner around the periphery thereof.

8. The method set forth in claim 4 including the step of:

sewing said cover member to said liner around the periphery thereof.

9. The method set forth in claim 1 including the step of:

sewing said inlay to said one of said cover member and said liner around the periphery of said window.

10. The method set forth in claim 1 including the step of:

providing a photo-copier apparatus, placing an article containing said image on said copier apparatus and transferring said image from said article containing said image to said transfer sheet; and transferring said image from said transfer sheet to said inlay by at least one of pressing and heating said transfer sheet against said inlay.

11. The method set forth in claim 10 including the step of:

providing said inlay as a heat resistant fabric.

12. The method set forth in claim 11 including the step of:

providing said inlay of heat resistant woven polyester.

13. The method set forth in claim 1 including the step of:

providing said cover member formed of a flexible polymer material having a thickness not less than about 0.050 inches and providing said liner as a sheet of polymer material having a thickness not less than about 0.15 inches.

14. The method set forth in claim 1 including the step of:

securing a flap to said liner along at least two edges thereof.

15. A folder manufactured by the method set forth in claim 1.

16. An article comprising one of a folder and a portfolio comprising:

a cover member comprising a sheet of flexible material forming a front cover and a back cover and window in one of said covers;

an inlay sheet having an image formed thereon by transferring said image from a source of said image to a transfer sheet and from said transfer sheet to said inlay sheet; and said portfolio being formed by positioning said inlay sheet in said window and securing said inlay sheet to said cover member around the periphery of said window to form said front cover and said back cover with said image showing through said window.

17. The article set forth in claim 16 including:

a flexible liner member adapted to be secured to said cover member on each side of one of a spine and fold formed between said front cover and said back cover.

18. The article set forth in claim 17 including:

a pair of generally rectangular, spaced apart stiffening members dimensioned to be less in height and width than the height and width of said front cover and said back cover, respectively, said stiffening members being disposed between said liner and said cover member and spaced apart from each other on each side of said spine.

19. The article set forth in claim 18 wherein:

at least said stiffening member disposed between said liner and said front cover includes a layer of resilient foam material engaged with said inlay to hold said inlay taut and substantially free of wrinkles or the like.

20. The article set forth in claim 17 wherein:

said liner is bonded to said cover member at a substantially central position on said cover member between opposite side edges thereof to form said spine.

21. The article set forth in claim 16 wherein:

said image on said inlay sheet is formed by transferring said image from said source to said transfer sheet by photocopying said image onto said transfer sheet.

22. The article set forth in claim 21 wherein:

said image is transferred from said transfer sheet by heating and pressing said transfer sheet against said inlay sheet.

23. The article set forth in claim 16 wherein:

said cover member is formed of reinforced vinyl having a thickness of about 0.050 inches.

24. The article set forth in claim 23 wherein:

said liner is formed of vinyl having a thickness of about 0.015 inches.

25. The article set forth in claim 16 wherein:

said inlay sheet is formed of a heat resistant woven polyester.

26. The portfolio set forth in claim 13 including:

a generally sheetlike flap secured to said liner along two edges thereof to form a pocket.

27. A document carrying article comprising one of a folder and portfolio comprising:

a cover member comprising one of a front cover and a back cover for said article and formed of a sheet of flexible material having a window formed therein;

an inlay sheet having an image formed thereon from a source of said image; and said inlay sheet being positioned in said window and secured to said cover member around the periphery of said window to form said cover member with said image showing through said window.

28. The article set forth in claim 27 wherein:

said cover member comprises a single sheet forming said front cover and said back cover and said window is formed in said front cover.

29. The article set forth in claim 27 including:

a flexible liner member adapted to be secured to said cover member.

30. The article set forth in claim 29 including:

at least one, generally rectangular, stiffening member dimensioned to be less in height and width than the height and width of said cover member, said stiffening member being disposed between said liner and said cover member.

31. The article set forth in claim 30 wherein:

said stiffening member includes a layer of resilient foam material engaged with said inlay sheet to hold said inlay sheet taut and substantially wrinkle free.

32. The article set forth in claim 28 wherein:

said liner is bonded to said cover member at a substantially central position on said cover member between opposite side edges thereof to form a spine of said article.

33. The article set forth in claim 27 wherein:

said image is formed on said inlay sheet by transferring said image from said source to a transfer sheet by photocopying said image onto said transfer sheet.

34. The article set forth in claim 33 wherein:

said image is transferred from said transfer sheet by heating and pressing said transfer sheet against said inlay sheet.

35. An article comprising one of a folder and a portfolio comprising:

a cover member comprising a sheet of flexible material forming at least part of a front cover and a back cover of said article and having an edge extending at least part way across one of said front cover and said back cover;

a flexible liner member adapted to be secured to said cover member on each side of one of a spine and fold formed between said front cover and said back cover;

an inlay sheet having an image formed thereon by transferring said image from a source of said image;

said article being formed by securing said inlay sheet to said cover member along said edge and securing said cover member to said liner.

36. The article set forth in claim 35 including:

a pair of generally rectangular, spaced apart stiffening members dimensioned to be less in height and width than the height and width of said front cover and said back cover, respectively, said stiffening members being disposed between said liner and said cover member and spaced apart from each other on each side of said spine.

37. The article set forth in claim 35 wherein:

at least said stiffening member disposed between said liner and said front cover includes a layer of resilient foam material engaged with said inlay sheet to hold said inlay sheet taut and substantially free of wrinkles or the like.

38. The article set forth in claim 35 wherein:

said image on said inlay sheet is formed by transferring said image from said source to a transfer sheet by photocopying said image onto said transfer sheet.

39. The article set forth in claim 38 wherein:

said image is transferred from said transfer sheet by heating and pressing said transfer sheet against said inlay sheet.

40. The article set forth in claim 39 wherein:

said inlay sheet is formed of a heat resistant woven polyester.

41. The article set forth in claim 35 wherein:

said article is formed by stitching said cover member to said liner and to said inlay sheet along contiguous edges of each, respectively.

42. A method of making an article comprising a folder or portfolio characterized by an exterior cover member forming at least part of a front cover and a back cover and an inlay sheet having an image thereon and secured to said cover member to provide ornamental indicia on one of said front cover and said back cover of said portfolio, said method comprising the steps of:

forming said cover member;

forming a flexible interior liner adapted to be secured to said cover member;

forming said inlay sheet from a sheet of flexible material;

providing an image on said inlay sheet;

placing said inlay sheet adjacent to said cover member;

securing said inlay sheet to said cover member; and securing said cover member to said liner.

43. The method set forth in claim 42 including the step of:

placing at least one stiffening part between said cover member and said liner.

44. The method set forth in claim 42 including the step of:

securing said cover member to said liner by bonding said cover member to said liner around the periphery thereof.

45. The method set forth in claim 42 including the step of:

sewing said cover member to said liner around the periphery thereof.

* * * * *